US006756977B2

(12) United States Patent
Ide

(10) Patent No.: US 6,756,977 B2
(45) Date of Patent: Jun. 29, 2004

(54) DISPLAY DEVICE AND METHOD OF DRIVING A DISPLAY PANEL

(75) Inventor: Shigeo Ide, Yamanashi (JP)

(73) Assignees: Pioneer Corporation, Tokyo (JP); Shizuoka Pioneer Corporation, Shizuoka (JP)

( * ) Notice: Subject to any disclaimer, the term of this patent is extended or adjusted under 35 U.S.C. 154(b) by 259 days.

(21) Appl. No.: 10/140,204

(22) Filed: May 8, 2002

(65) Prior Publication Data

US 2002/0175908 A1 Nov. 28, 2002

(30) Foreign Application Priority Data

May 24, 2001 (JP) ..... 2001-155473

(51) Int. Cl.[7] ..... G09G 5/00
(52) U.S. Cl. ..... 345/212; 345/690
(58) Field of Search ..... 315/169.1, 169.3; 345/204, 208, 211, 212, 213, 60, 61, 63, 690

(56) References Cited

U.S. PATENT DOCUMENTS 6,011,355 A * 1/2000 Nagai ..... 315/169.3
6,150,999 A * 11/2000 Chen et al. ..... 345/60
6,583,575 B2 * 6/2003 Roh et al. ..... 315/169.1
6,618,042 B1 * 9/2003 Powell ..... 345/204
6,636,187 B2 * 10/2003 Tajima et al. ..... 345/55

* cited by examiner

*Primary Examiner*—Kent Chang
(74) *Attorney, Agent, or Firm*—Sughrue Mion, PLLC

(57) ABSTRACT

A display device in which a driver circuit supplies a sustain discharge pulse between a pair of row electrodes by performing a process having, under a state fixed one row electrode for each pair of row electrodes at a first potential in a light emission sustain period of a display panel, a first step of gradually changing the potential of the other row electrode for each pair of row electrodes from the first potential toward a second potential by means of resonance between a capacitive load and a first inductor; a second step of fixing the other row electrode in the pair of row electrodes at the second potential; and a third step of gradually changing the potential of the other row electrode of the pair of row electrodes from the second potential toward the first potential by means of resonance between the capacitive load and a second inductor; performs the second step before the potential of the other row electrode of the pair of row electrodes reaches the second potential at the first step when power consumption is not limited; and reduces the length of the period of the second step and performs the third step after completion of the reduced second step when power consumption is limited.

4 Claims, 12 Drawing Sheets

FIG. 4
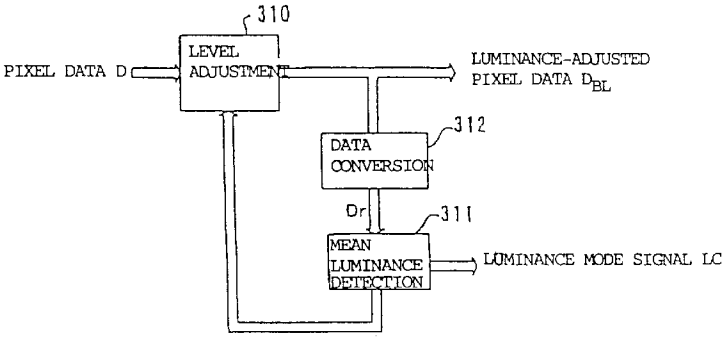
FIG. 5
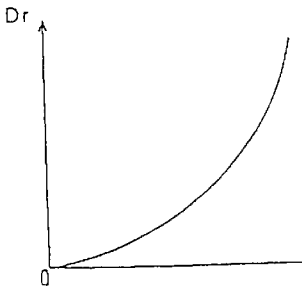
FIG. 6
| LC | SF1 | SF2 | SF3 | SF4 | SF5 | SF6 | SF7 | SF8 | SF9 | SF10 | SF11 | SF12 | SF13 | SF14 |
|---|---|---|---|---|---|---|---|---|---|---|---|---|---|---|
| FIRST MODE | 4 | 12 | 20 | 32 | 40 | 52 | 64 | 76 | 88 | 100 | 112 | 128 | 140 | 156 |
| SECOND MODE | 3 | 9 | 15 | 24 | 30 | 39 | 48 | 57 | 65 | 75 | 84 | 96 | 105 | 117 |

FIG. 9

(SELECTIVE ERASING)

| GRADATION LEVEL | SF1 | SF2 | SF3 | SF4 | SF5 | SF6 | SF7 | SF8 | SF9 | SF10 | SF11 | SF12 | SF13 | SF14 | EMISSION INTENSITY FIRST MODE | EMISSION INTENSITY SECOND MODE |
|---|---|---|---|---|---|---|---|---|---|---|---|---|---|---|---|---|
| 1 | ● | | | | | | | | | | | | | | 0 | 0 |
| 2 | ○ | ● | | | | | | | | | | | | | 4 | 3 |
| 3 | ○ | ○ | ● | | | | | | | | | | | | 16 | 12 |
| 4 | ○ | ○ | ○ | ● | | | | | | | | | | | 36 | 27 |
| 5 | ○ | ○ | ○ | ○ | ● | | | | | | | | | | 68 | 51 |
| 6 | ○ | ○ | ○ | ○ | ○ | ● | | | | | | | | | 108 | 81 |
| 7 | ○ | ○ | ○ | ○ | ○ | ○ | ● | | | | | | | | 160 | 120 |
| 8 | ○ | ○ | ○ | ○ | ○ | ○ | ○ | ● | | | | | | | 224 | 168 |
| 9 | ○ | ○ | ○ | ○ | ○ | ○ | ○ | ○ | ● | | | | | | 300 | 225 |
| 10 | ○ | ○ | ○ | ○ | ○ | ○ | ○ | ○ | ○ | ● | | | | | 388 | 291 |
| 11 | ○ | ○ | ○ | ○ | ○ | ○ | ○ | ○ | ○ | ○ | ● | | | | 488 | 366 |
| 12 | ○ | ○ | ○ | ○ | ○ | ○ | ○ | ○ | ○ | ○ | ○ | ● | | | 600 | 450 |
| 13 | ○ | ○ | ○ | ○ | ○ | ○ | ○ | ○ | ○ | ○ | ○ | ○ | ● | | 728 | 546 |
| 14 | ○ | ○ | ○ | ○ | ○ | ○ | ○ | ○ | ○ | ○ | ○ | ○ | ○ | ● | 868 | 651 |
| 15 | ○ | ○ | ○ | ○ | ○ | ○ | ○ | ○ | ○ | ○ | ○ | ○ | ○ | ○ | 1024 | 768 |

SOLID CIRCLES: SELECTIVE ERASE DISCHARGE
OPEN CIRCLES: LIGHT EMISSION

FIG. 10

(SELECTIVE ERASING)

| Ds | HD 1 | 2 | 3 | 4 | 5 | 6 | 7 | 8 | 9 | 10 | 11 | 12 | 13 | 14 | LIGHT EMISSION PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | EMISSION LUMINANCE |
|---|---|---|---|---|---|---|---|---|---|---|---|---|---|---|---|---|---|---|---|---|---|---|---|---|---|---|---|---|---|
| 0000 | 1 | 0 | 0 | 0 | 0 | 0 | 0 | 0 | 0 | 0 | 0 | 0 | 0 | 0 | ● | | | | | | | | | | | | | | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

SOLID CIRCLES: SELECTIVE ERASE DISCHARGE
OPEN CIRCLES: LIGHT EMISSION

DISPLAY DEVICE AND METHOD OF DRIVING A DISPLAY PANEL

BACKGROUND OF THE INVENTION

1. Field of the Invention

The present invention relates to a display device including a display panel such as a matrix-type plasma display panel (hereinafter referred to as a PDP).

2. Description of the Related Background Art

In recent years, the size of display devices is becoming increasingly great, and the increase in the display device size has created a need for a reduction in the display device thickness. To meet such a requirement, various thin types of display devices have been developed and are practically used. A display device using an AC (Alternate Current) PDP is one of promising thin types of display devices.

A PDP includes a plurality of column electrodes (address electrodes) and a plurality of pairs of row electrodes extending in such a manner as to cross the column electrodes. The row and column electrodes are covered with a dielectric layer such that the surfaces thereof are not directly exposed in a discharge space. A discharge cell serving as one pixel is formed at each intersection between the row electrode pairs and the column electrodes. In the PDP, light is emitted by using a discharge, and each discharge cell can be only in either a state in which light is emitted or a state in which no light is emitted. In the PDP, multiple luminance levels are achieved by means of a subfield method, to represent halftone in accordance with an input video signal. In the subfield method, each field display period is divided into N subfields, and a number of times light is emitted for each subfield is determined depending on a weighting factor for performing light emission.

However, in the display device using the subfield method, the number of times light is emitted is determined in a fixed manner depending only on the weighting factor for each subfield, and the manner of determining the number of times light is emitted is not changed in any situation. This can cause a displayed image to become very dazzling when the luminance of light emission becomes high on a screen all over.

One known technique of avoiding the above problem is to use an automatic brightness limiter (ABL controller) for limiting the screen luminance in the display device based on the subfield method as in other types of display devices such as a CRT display. As a result of the luminance limitation, power consumption of the display device is limited.

The automatic brightness limiter limits the number of sustain pulses (the number of times light is emitted) in each subfield, based on luminance information (for example, an average luminance level) of an input image signal, thereby limiting the luminance level of the image signal.

However, in the display device in which power consumption is limited on the basis of the conventional technique, it is difficult to obtain not only optimal luminance but also good light emission efficiency.

SUMMARY OF THE INVENTION

It is an object of the present invention to provide a display device and a display panel driving method which each have a capability of limiting the power consumption of a driver circuit of a display panel and are each capable of displaying an image with improved luminance and increased light emission efficiency.

According to an aspect of the present invention, there is provided a display device comprising a display panel including a plurality of pairs of row electrodes between which a capacitive load is formed, and a plurality of column electrodes arrayed in the direction intersecting with the row electrodes so as to form discharge cells at respective intersections of the row electrode pairs and the column electrodes; a driver circuit for supplying a sustain discharge pulse between a pair of row electrodes by performing a process having: under a state fixed one row electrode for each of the pairs of row electrodes at a first potential in a light emission sustain period of the display panel, a first step of gradually changing the potential of the other row electrode for each of the pairs of row electrodes from the first potential toward a second potential by means of resonance between the capacitive load and a first inductor; a second step of fixing the other row electrode in the pair of row electrodes at the second potential; and a third step of gradually changing the potential of the other row electrode of the pair of row electrodes from the second potential toward the first potential by means of resonance between the capacitive load and a second inductor; and a power limiting circuit for limiting power consumption of the driver circuit, in accordance with luminance information of an input image signal; wherein when the power consumption of the driver circuit is not limited by the power limiting circuit, the driver circuit performs the second step before the potential of the other row electrode of the pair of row electrodes reaches the second potential at the first step, while when, the power consumption of the driver circuit is limited by the power limiting circuit, the driver circuit reduces the length of the period of the second step and performs the third step after completion of the reduced second step.

According to another aspect of the present invention, there is provided a method of driving a display panel having a plurality of pairs of row electrodes between which a capacitive load is formed, and a plurality of column electrodes arrayed in the direction intersecting with the row electrodes so as to form discharge cells at respective intersections of the row electrode pairs and the column electrodes, the method comprising: supplying a sustain discharge pulse between a pair of row electrodes by performing a process having, under a state fixed one row electrode for each of the pairs of row electrodes at a first potential in a light emission sustain period of the display panel, a first step of gradually changing the potential of the other row electrode for each of the pairs of row electrodes from the first potential toward a second potential by means of resonance between the capacitive load and a first inductor; a second step of fixing the other row electrode in the pair of row electrodes at the second potential; and a third step of gradually changing the potential of the other row electrode of the pair of row electrodes from the second potential toward the first potential by means of resonance between the capacitive load and a second inductor; performing the second step before the potential of the other row electrode of the pair of row electrodes reaches the second potential at the first step when power consumption is not limited; and reducing the length of the period of the second step and performing the third step after completion of the reduced second step when power consumption is limited.

BRIEF DESCRIPTION OF THE DRAWINGS

FIG. 4 is a diagram showing an internal construction of an ABL controller;

FIG. 5 is a graph showing the conversion characteristic of the data converter;

FIG. 6 is a table showing the relative number of times light emission is performed in each subfield, for each luminance mode;

FIG. 9 is a diagram showing an example of a light emission driving pattern according to the light emission driving scheme shown in FIG. 2;

FIG. 10 is a diagram showing all possible light emission driving patterns according to the light emission driving scheme shown in FIG. 2, and also showing an example of a conversion table used by a second data converter to perform the light emission driving process;

DETAILED DESCRIPTION OF THE PREFERRED EMBODIMENTS

Embodiments of the present invention are described in detail below with reference to drawings.

Figure 1:
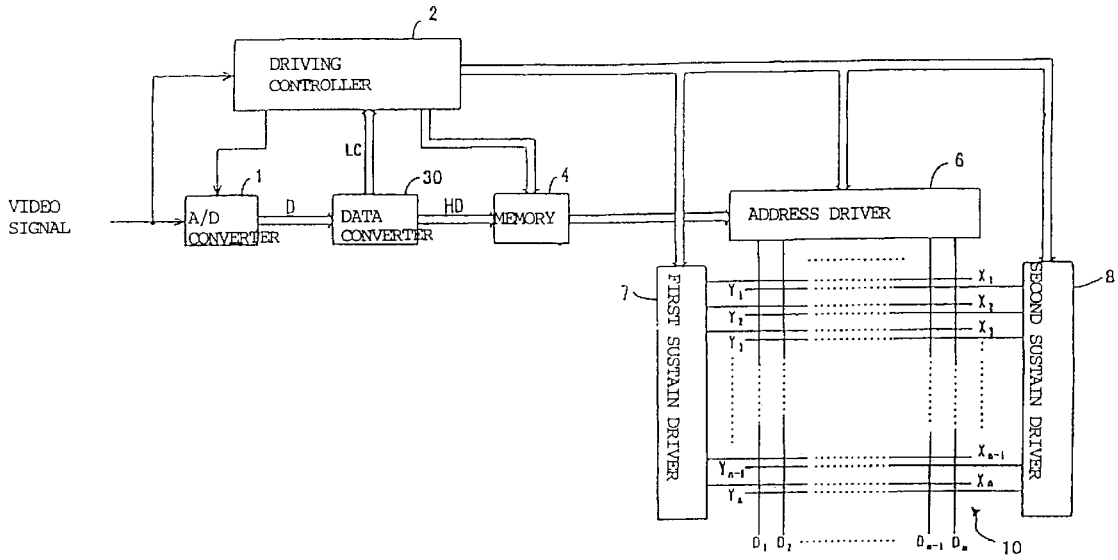
FIG. 1 is a diagram showing a general construction of a display device according to the present invention.

FIG. 1 is a diagram showing a general construction of a display device using a plasma display panel (hereinafter, referred to as a PDP) according to the present invention.

As shown in FIG. 1, the display device includes an A/D (analog-to-digital) converter 1, a driving controller 2, a data converter 30, a memory 4, a PDP 10, an address driver 6, and first and second sustain drivers 7 and 8.

In response to a clock signal supplied from the driving controller 2, the A/D converter 1 samples an input analog video signal and converts the sampled signal into, for example, 8-bit pixel data (input pixel data) D on a pixel-by-pixel basis. The resultant 8-bit pixel data D is supplied to the data converter 30.

The driving controller 2 generates a clock signal and a write/read signal synchronously with horizontal and vertical synchronization signals included in the input video signal, and supplies the generated clock signal to the A/D converter 1 and the write/read signal to the memory 4. Furthermore, in synchronization with the horizontal and vertical synchronization signals, the driving controller 2 generates various timing signals for driving/controlling the address driver 6, the first sustain driver 7 and the second sustain driver 8.

The data converter 30 converts the 8-bit pixel data D into 14-bit pixel data (display pixel data) HD and supplies the resultant data to the memory 4. The conversion process performed by the data converter 30 will be described later.

In the memory 4, the converted pixel data HD is sequentially written in accordance with the write signal supplied from the driving controller 2. After one frame (including n rows and m columns) of converted pixel data has been written in the writing process, one frame of converted pixel data $HD_{11\text{-}nm}$ is read on a bit-by-bit basis from the memory 4 and sequentially supplied to the address driver 6 on a row-by-row basis.

In response to the timing signal supplied from the driving controller 2, the address driver 6 generates m pixel data pulses having voltages corresponding to logical levels of the respective converted pixel data bits of one row read from the memory 4. The generated pixel data pulses are supplied to the respective column electrodes $D_1$ to $D_m$ of the PDP 10.

The PDP 10 includes column electrodes $D_1$ to $D_m$ serving as address electrodes and row electrodes $X_1$ to $X_n$ and $Y_1$ to $Y_n$ extending in a direction perpendicular to a direction in which the column electrodes $D_1$ to $D_m$ extend. In this PDP 10, one pair of a row electrode X and a row electrode Y form one complete row electrode. More specifically, in the PDP 10, a first row electrode $X_1$ and a first row electrode $Y_1$ form a first complete row electrode, and an nth row electrode $X_n$ and an nth row electrode $Y_n$ form an nth complete row electrode. The row electrodes and column electrodes are each covered with a dielectric layer for a discharge space and each have one discharge cell corresponding to one pixel is formed at each intersection of each column of electrodes and each complete row of electrodes.

In response to the timing signal supplied from the driving controller 2, the first sustain driver 7 and the second sustain driver 8 generate various driving pulses, which will be described later, and supply them to the row electrodes $X_1$ to $X_n$ and $Y_1$ to $Y_n$ of the PDP 10.

Figure 2:
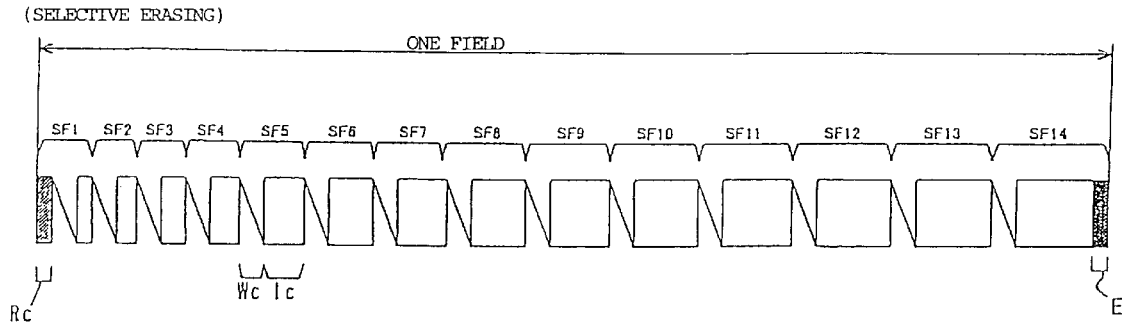
FIG. 2 is a diagram showing a format of a display driving signal according to a selective erase addressing scheme.

In this plasma display device, each field display period is divided into 14 subfields SF1 to SF14 as shown in FIG. 2, and the PDP 10 is driven on a subfield-by-subfield basis in response to a timing signal supplied from the driving controller 2.

Figure 3:
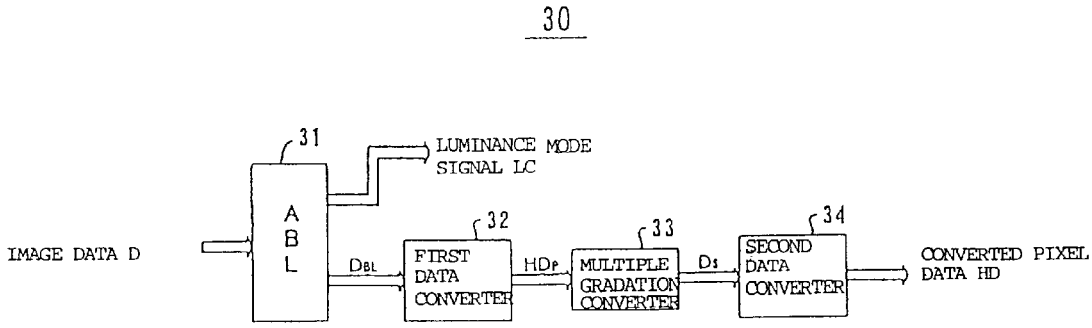
FIG. 3 is a diagram showing an internal construction of a data converter.
Figure 7:
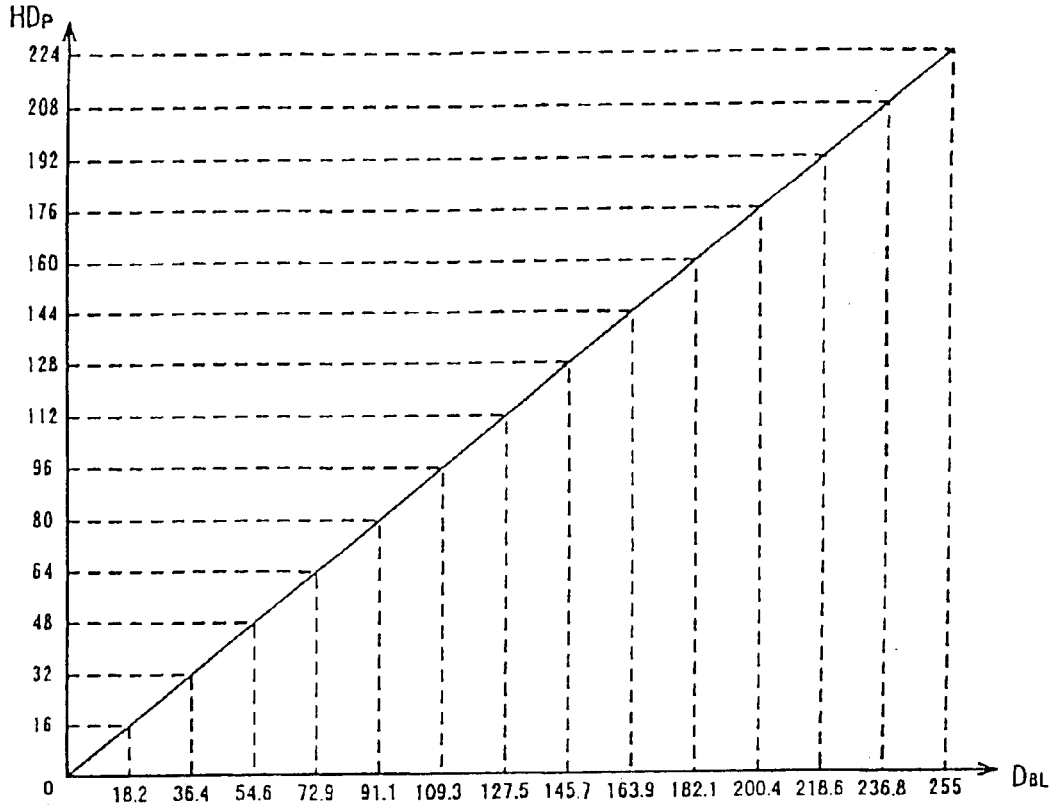
FIG. 7 is a graph showing the conversion characteristic of a first data converter.

FIG. 3 shows the internal construction of the data converter 30. As shown in FIG. 3, the data converter 30 includes an ABL (automatic brightness level) controller 31, a first data converter 32, a multiple gradation level converter 33 and a second data converter 34.

The ABL controller 31 adjusts the luminance level of each pixel data D sequentially supplied from the analog-to-digital converter 1 such that the mean luminance level of an image displayed on the screen of the PDP 10 exists within a predetermined range. The resultant luminance-adjusted pixel data $D_{BL}$ is supplied to the first data converter 32.

The above-described adjustment of the luminance level is performed before an inverse gamma conversion is performed after nonlinearly setting the relative numbers of times light is emitted for the respective subfields. Then, the ABL controller 31 perform the inverse gamma conversion on the pixel data (input pixel data) D and automatically adjusts the luminance level, depending on the mean luminance of the data obtained via the inverse gamma conversion, thereby preventing the image quality from being degraded by the luminance level adjustment.

FIG. 4 shows the internal construction of an ABL controller 31.

In FIG. 4, a level adjusting circuit 310 adjusts the level of the pixel data D, depending on the mean luminance determined by a mean luminance detection circuit 311 that will be described later, and outputs the resultant luminance-adjusted pixel data $D_{BL}$. The data converter 312 converts the luminance-adjusted pixel data $D_{BL}$ in accordance with an inverse gamma conversion characteristic ($Y=X^{2.2}$) such as that shown in FIG. 5 and supplies the resultant data as inverse-gamma-converted pixel data Dr to the mean luminance detection circuit 311. That is, the data converter 312 performs an inverse gamma conversion on the luminance-adjusted pixel data $D_{BL}$ thereby reproducing pixel data (inverse-gamma-converted pixel data Dr) whose gamma correction has been cancelled so as to correspond to the original video signal.

The mean luminance detection circuit 311, to designate a light emission period (number of times light is to be emitted) for each subfield, selects a luminance mode in which the PDP 10 is driven, depending upon the mean luminance level determined in the above-described manner, from first and second modes described in FIG. 6 and supplies a luminance mode signal LC indicating the selected luminance mode to the driving controller 2. Herein, the driving controller 2 determines the period during which light is emitted in the sustain light emission step Ic for each subfield SF1 to SF14 shown in FIG. 2, that is, the number of sustain pulses applied in each sustain light emission step Ic, in accordance with the number-of-emissions ratio shown in FIG. 6, in the mode designated by the luminance mode signal LC. More specifically, when the mean luminance level of the input pixel data D is lower than a predetermined value, the luminance mode is set to the first mode. If the mean luminance level becomes equal to or greater than the predetermined value, the luminance mode is switched to the second mode in which the number of times light is emitted in each subfield is smaller than that in the first mode.

The mean luminance detection circuit 311 determines the mean luminance from the inverse-gamma-converted pixel data Dr and supplies data indicating the resultant mean luminance to the level adjusting circuit 310.

The first data converter 32 shown in FIG. 3 converts the 256-level (8-bit) luminance-adjusted pixel data $D_{BL}$ into 14 I 16/255 (224/255)-level 8-bit (0 to 224) data and supplies the resultant data as level-converted pixel data HDP to the multiple gradation level converter 33. More specifically, the 8-bit (0 to 255) luminance-adjusted pixel data $D_{BL}$ is converted in accordance with the conversion table representing the conversion characteristic. The conversion characteristic is set depending on the number of bits of the input pixel data, the number of bits of data obtained after the compression via the multilevel conversion, and the number of gradation levels. Thus, using the first data converter 32 disposed in front of the multiple gradation level converter 33 that will be described later, the conversion is performed depending on the number of gradation levels and the number of bits of data compressed via the multilevel conversion. In this process, given luminance-adjusted pixel data $D_B$ is divided at a bit boundary into high-order bits (that will be used to produce gradation-level-converted pixel data) and low-order bits (or error bits that will be truncated, and the multilevel conversion is performed on the resultant data. This prevents a plateau from appearing in the display characteristic (that is, gradation level distortion is prevented), which would occur if luminance saturation occurs during the multilevel conversion process or the gradation level does not correspond to a bit boundary.

When the low-order bits are truncated, a reduction in the number of gray levels occurs. However, the lost gray levels are recovered by means of pseudo-representation by the multiple gradation level converter 33.

Figure 8:
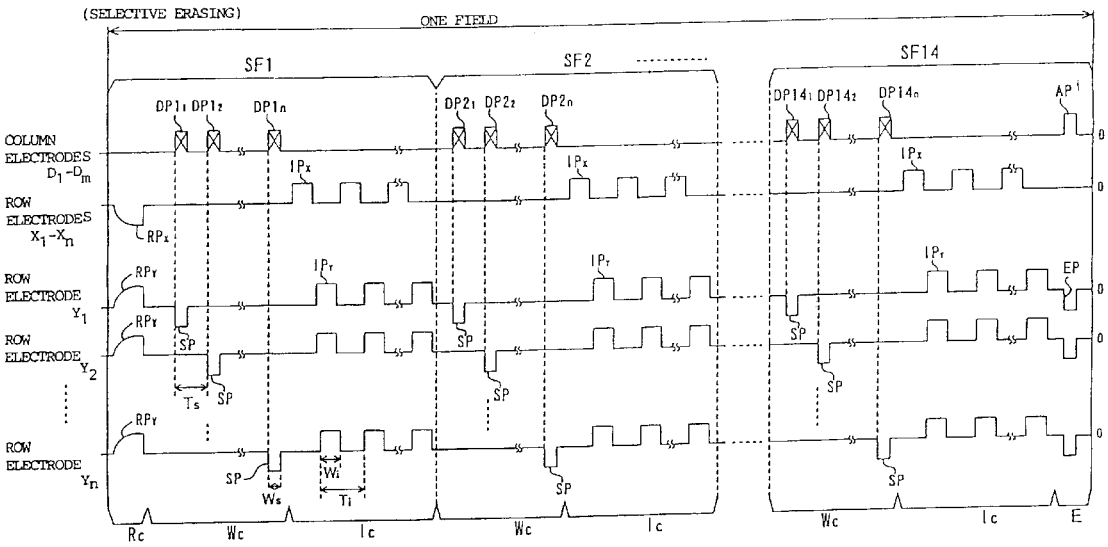
FIG. 8 is a diagram showing timings of various driving pulses applied to respective electrodes of a PDP.

FIG. 8 shows timings of various driving pulses applied to the column electrodes D and the row electrodes X and Y of the PDP 10 from the address driver 6 and the first and second sustain drivers 7 and 8 in accordance with various timing signals supplied from the driving controller 2.

As shown in FIG. 8, in an all-reset step Rc that is performed only in a subfield SF1, the first sustain driver 7 and the second sustain driver 8 simultaneously supply negative reset pulses $RP_X$ and positive reset pulses $RP_Y$ to the row electrodes $X_1$ to $X_n$ and $Y_1$ to $Y_n$ whereby all discharge cells of the PDP 10 are reset-discharged and a wall charge is equally formed in each discharge cell. As a result, the all discharge cells of the PDP 10 are initialized into the light emission state.

In the following pixel data write step Wc for each subfield, the address driver 6 generates pixel data pulses $DP1_{11\text{-}nm}$ to $DP14_{11\text{-}nm}$ from $DB1_{11\text{-}nm}$ to $DB14_{11\text{-}nm}$ supplied from the memory such that the pixel data pulses $DP1_{11\text{-}nm}$ to $DP14_{11\text{-}nm}$ have voltages corresponding to the logical levels of the $DB1_{11\text{-}nm}$ to $DB14_{11\text{-}nm}$ supplied from the memory. The address driver 6 assigns those pixel data pulses $DP11_{11\text{-}nm}$ to $DP14_{11\text{-}nm}$ to the respective subfields SF1 to SF14 and sequentially applies them to the column electrode $D_{1\text{-}m}$ row by row and subfield by subfield. More specifically, for example, in the pixel data write step Wc for the subfield SF1, data corresponding to the first row, that is $DB1_{1\text{-}m}$, is extracted from $DB1_{11\text{-}nm}$, and m pixel data pulses $DP1_1$ corresponding to the logical levels of $DB_{11\text{-}1m}$ are generated. The resultant pixel data pulses $DP1_1$ are supplied to the column electrode $D_{1\text{-}m}$. Thereafter, data corresponding to the second row, that is $DB1_{21\text{-}2m}$, is extracted from $DB1_{11\text{-}nm}$ and then m pixel data pulses $DP1_2$ corresponding to the logical levels of $DB1_{21\text{-}2m}$ are generated and simultaneously applied to the column electrode $D_{1\text{-}m}$. Furthermore, in the pixel data write step Wc for the subfield SF1, pixel data pulses $DP1_3$ to $DP1_n$ are generated in a similar manner row by row and sequentially applied to the column electrode $D1_{1\text{-}m}$. In the above process, when the logical level of DB1 is "1", the address driver 6 generates a high-level pixel data pulse, while the address driver 6 generates a low-level (zero-voltage) pixel data pulse when the logical level of DB1 is "0". In the pixel data write step Wc for the subfield SF2, data corresponding to the first row, that is $DB2_{11\text{-}nm}$, is extracted from $DB2_{11\text{-}nm}$, and m pixel data pulses $DP2_1$ corresponding to the logical levels of $DB2_{11\text{-}nm}$ are generated and applied to the column electrode $D_{1\text{-}m}$. Then, data corresponding to the second row, that is $DB2_{21\text{-}2m}$, is extracted from $DB2_{11\text{-}nm}$, and m pixel data pulses $DP2_2$ corresponding to the logical levels of $DB2_{21\text{-}2m}$ are generated and applied to the column electrode $D_{1\text{-}m}$. Furthermore, in the pixel data write step Wc for the subfield SF2, pixel data pulses $DP2_3$ to $DP2_n$ are generated in a similar manner row by row and sequentially applied to the column electrode $D_{1\text{-}m}$.

Similarly, in the following pixel data write steps Wc for subfields SF3 to SF14, the address driver 6 generates pixel data pulses $DP3_{1\text{-}n}$ to $DP14_{1\text{-}n}$ from $DB3_{11\text{-}nm}$ to $DB14_{11\text{-}nm}$ and sequentially applies them to the column electrode $D_{1\text{-}m}$ row by row.

The second sustain driver 8 generates a negative scanning pulse SP shown in FIG. 8 in synchronization with the timings of applying the pixel data pulses DP described above, and sequentially applies them to the row electrodes $Y_1$ to $Y_n$. Thus, a discharge (selective erase discharge) occurs only in a discharge cell located at an intersection between a row to which a scanning pulse SP is applied and a column to which a high-level pixel data pulse is applied, and the wall charge remaining in that discharge cell is selectively erased. Thus, the selective erase discharge causes the discharge cell, which has been initialized into the light emission state in the all-reset step Rc, to be brought into a non-light emission state. Note that no discharge occurs in discharge cells in a column to which a low-level pixel data pulse is applied, and thus the discharge cells remain in the initial light emission state into which they have been brought in the all-reset step Rc.

In the following light emission sustain step Ic for each subfield, the first sustain driver 7 and the second sustain driver 8 alternately apply positive sustain pulses $IP_X$ and $IP_Y$ to the row electrodes $X_1$ to $X_n$ and $Y_1$ to $Y_n$. In this light emission sustain step Ic for each subfield, the number of times (period) the sustain pulses $IP_X$ and $IP_Y$ are applied is determined for each subfield SF. For example, in the subfields SF1 to SF14 shown in FIG. 2, if light is emitted four times in the subfield SF1, then the numbers of times (period) the sustain pulses $IP_X$ and $IP_Y$ are applied in the light emission sustain step for the respective subfields are determined as follows:

SF1: 4
SF2: 12
SF3: 20
SF4: 32
SF5: 40
SF6: 52
SF7: 64
SF8: 76
SF9: 88
SF10: 100
SF11: 112
SF12: 128
SF13: 140
SF14: 156

Thus, each time a sustain pulse $IP_X$ or $IP_Y$ is applied, a sustain discharge occurs in discharge cells in the light emission state, that is, in discharge cells retaining the wall charge formed in the pixel data write step Wc, so that the light emission state is maintained over periods corresponding to the numbers of sustain pulses assigned to the respective subfields. Thus, in the light emission sustain step Ic in the subfield SF1, light emission is performed for low-luminance components of the input video signal, while, in the light emission sustain step Ic in the subfield SF14, light emission is performed for high-luminance components.

As shown in FIG. 8, an erase step E is performed in and only in the last subfield SF14. In this erase step E, the address driver 6 generates an erase pulse AP and supplies it to the column electrode $D_{1-m}$. In synchronization with the application of the erase pulse AP, the second sustain driver 8 generates an erase pulse EP and applies it to the row electrodes $Y_1$ to $Y_n$. As a result of the simultaneous application of the erase pulses AP and EP, an erase discharge occurs in all discharge cells of the PDP 10 and the wall charge remaining in any discharge cell is eliminated. Thus, the erase discharge causes all discharge cells of the PDP 10 to be brought into the non-light emission state.

FIG. 9 shows all possible light emission driving patterns according to the light emission scheme shown in FIG. 8.

As shown in FIG. 9, the selective erase discharge for each discharge cell is performed in a pixel data write step Wc only in one of the subfields SF1 to SF14 (selective erase discharges are denoted by solid circles in FIG. 9). That is, the wall charges, which are formed in all discharge cells of the PDP 10 during the all-reset step Rc, are maintained until the selective erase discharge is performed, and light emission discharges are performed (as represented by open circles in FIG. 9) in the sustain emission step Ic, for the respective subfields SF, during the periods in which the wall charges are maintained. That is, each discharge cell is maintained in the light emission state until the selective erase discharge is performed in each field, and light emission is performed in the sustain emission step Ic in each subfield, during the period determined in accordance with the assigned period ratio, as shown in FIG. 2.

Herein, as shown in FIG. 9, in each discharge cell, only one or no transition can occur from the light emission state to the non-light emission state. That is, in any light emission driving pattern, if once a certain discharge cell is brought into the non-light emission state in a certain field, that discharge cell cannot be again brought into the light emission state in the same field.

Thus, the all-reset operation, which results in emission of high-intensity light having no contribution to displaying an image, is performed only once in each field as shown in FIGS. 2 and 8, and thus the reduction in the contrast is minimized.

On the other hand, the selective erase discharge is performed at most once in each field, as represented by solid circles in FIG. 9, and thus electric power consumed thereby is minimized.

Furthermore, as can be seen from FIG. 9, such a light emission pattern is not allowed which would be equal to an inversion of any other light emission pattern, that is, any light emission pattern cannot be equal to a pattern obtained by inverting any other light emission pattern such that the original light emission period in one field is converted into a non-light emission period and the original non-light emission period is converted into a light emission period. This suppresses the formation of a false image edge.

The widths of scanning pulses SP applied in the respective subfields SF1 to SF14 are determined such that a scanning pulse SP applied in a subfield at a location earlier in time has a greater pulse width than those applied in subfields at later locations, for the following reason. When a selective erase operation is performed in a certain subfield, if prior subfields are in the light emission state in which sustain emission discharges are performed repeatedly (that is, the luminance is high), there are sufficient priming particles in the discharge space, which ensure that the selective erase discharge occurs in a highly reliable fashion. On the other hand, in the case where there is no subfield in the light emission state before the subfield in which the selective erase operation is performed, or in the case where although there are subfields in the light emission state, the number of such subfields is small (as is the case when the selective erase discharge is performed in the subfield SF1 or SF2), the sustain emission discharge has been performed only a small number of times, and thus the discharge space does not include a sufficiently large number of priming particles. If the selective erase discharge is performed in a subfield without having sufficient priming particles in the discharge space, the selective erase discharge does not occur immediately after the application of the scanning pulse SP but it occurs after a delay of time. This causes the selective erase discharge to become unstable, and a false discharge can occur during the sustain discharge period, which results in degradation in the image quality. To prevent the above problem, the widths of the scanning pulses SP applied in subfields SF1 to SF14 are set such that a scanning pulse SP at a location earlier in time has a greater width than any scanning pulse SP at a later location. That is, the width of the scanning pulse SP applied in the first subfield SF1 (first group of subfields) in each field is set to be greater than the width of any scanning pulse SP applied in the following subfields SF2 (second group of subfields), SF3 (third group of subfields), . . . , SF14 (fourteenth group of subfields), thereby ensuring that a selective erase discharge occurs in a highly reliable fashion when a scanning pulse SP is applied, and thus ensuring the stability of the selective erase operation.

For the same subfield, the width of the scanning pulse SP is set such that the width of the scanning pulse SP in the second mode becomes greater than in the first mode, for the following reason. In the operation, as described earlier, after selecting the first or second mode depending on the mean luminance level of the input pixel data D, the light emission intensity (luminance) is controlled by controlling the number of times light is emitted during the sustain discharge period in the same subfield (that is, by controlling the number of sustain pulses). If the mean luminance level of the input pixel data D becomes equal to or greater than the predetermined value, the mode is switched to second mode. In the second mode, sustain emission discharge is performed a smaller number of times than in the first mode, and thus the number of priming particles created in the discharge space by the sustain emission discharge becomes smaller than in the first mode. As a result, the selective erase discharge in the pixel data write step becomes less stable, and an incorrect discharge can occur in the sustain discharge period, which results in degradation in the image quality. To avoid the above problem, the width of the scanning pulse SP in each subfield is set such that the width becomes greater in the second mode than in the first mode (that is, the scan rate of the scanning pulse SP is set to be longer in the second mode than in the first mode), thereby ensuring that a selective erase discharge occurs in a highly reliable fashion when a scanning pulse SP is applied, and thus ensuring the stability of the selective erase operation.

The second data converter 34 converts the gradation-level-converted pixel data $D_s$, in accordance with a conversion table such as that shown in FIG. 10, into level-converted pixel data (display pixel data) HD consisting of 1st to 14th bits corresponding to the subfields SF1 to SF14. The gradation-level-converted pixel data $D_s$ is obtained as follows. First, data conversion is performed so as to convert input 8-bit (256-level) pixel data D into 224/225-level data. The resultant data is further compressed by 2 bits by means of a multilevel conversion process based on, for example, error diffusion or dithering. Thus, the data is finally converted into 4-bit (15-level) data.

Herein, of the 1st to 14th bits of the level-converted pixel data HD, those bits with a logical level of "1" indicate that, in the pixel data write step Wc, the selective erase discharge should be performed in subfields SF corresponding to the "1"-level bits.

The level-converted pixel data HD associated with each discharge cell of the PDP 10 is supplied to the address driver 6 via the memory 4. Herein, the level-converted pixel data HD associated with one discharge cell has one of fifteen patterns shown in FIG. 10. The address driver 6 assigns the 1st to 14th bits of the level-converted pixel data HD to the subfields SF1 to SF14, respectively, such that the pixel data pulse generated in the pixel data write step Wc for each subfield has a high voltage only when the bit corresponding to that subfield has a logical level of "1". The resultant pixel data pulse is applied to the column electrodes D of the PDP 10 so that the selective erase discharge occurs.

As described above, the 8-bit pixel data D is converted by the data converter 30 into 14-bit level-converted pixel data HD having one of 15 gradation levels as shown in FIG. 10. However, as described above, the process performed by the multiple gradation level converter 33 allows the resultant data to have as many as 256 gradation levels that are visually perceptible.

As described above, only in the first subfield of each field, a discharge is first performed in all discharge cells to initialize them into the light emission state (in the case where the selective erase address scheme is employed). Thereafter, in the pixel data write step, only in one of subfields, each discharge cell is set into the non-light emission state or light emission state depending on the pixel data. Furthermore, in the light emission sustain step for each subfield, light is emitted only in those cells in the light emission state for periods weighted depending on each subfield. In this driving method, when the selective erase address scheme is employed, as many subfields as required to represent given luminance are selected starting from the first subfield and they are set to be in the light emission state. On the other hand, when the selective erase address scheme is employed, as many subfields as required to represent given luminance are selected starting from the subfield located at the end of one field, and they are set to be in the light emission state.

Figure 11:
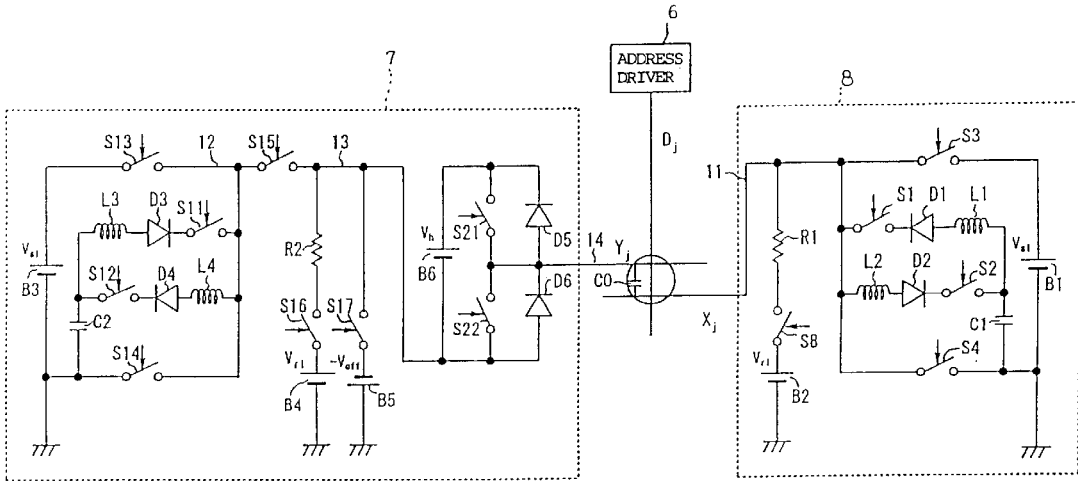
FIG. 11 is a circuit diagram showing specific examples of circuit configurations of first and second sustain drivers.

FIG. 11 shows a specific example of the construction of the first and second sustain drivers 7 and 8 associated with the electrodes $X_j$ and $Y_j$. Herein, the electrode $X_j$ denotes a jth electrode of row electrodes $X_1$ to $X_n$, and the electrode Y1 denotes a jth electrode of row electrodes $Y_1$ to $Y_n$. There is a capacitance C0 between the electrodes $X_j$ and $Y_j$.

The second sustain driver 8 includes two power sources B1 and B2. The power source B1 supplies a voltage $V_{s1}$ (170 V, for example), and the power source B2 supplies a voltage $V_{r1}$ (190 V, for example). The positive terminal of the power source B1 is connected via a switching element S3 to an interconnection line 11 connected to the electrode $X_j$, and the negative terminal is grounded. Between the interconnection line 11 and the ground line, a switching element S4 is directly connected, and furthermore, a series circuit of a switching element S1, a diode D1, and an inductor L1 and a series circuit of an inductor L2, a diode D2, and a switching element S2 are connected via a common capacitor C1 disposed on the ground side. The diodes D1 and D2 are connected to the capacitor C1 such that the anode of the diode D1 and the cathode of the diode D2 are connected to the capacitor C1. The positive terminal of the power source B2 is connected to the interconnection line 11 via a switching element S8 and a resistor R1, and the negative terminal of the power source B2 is grounded.

The first sustain driver 7 includes four power sources B3 to B6. The power source B3 supplies a voltage $V_{s1}$ (170 V, for example), and the power source B4 supplies a voltage $V_{r1}$ (190 V, for example). The power source B5 supplies a voltage $V_{off}$ (140 V, for example), and the power source B6 supplies a voltage $V_h$ (which is higher than $V_{off}$ and a specific value of which is 160 V, for example). The positive terminal of the power source B3 is connected via a switching element S13 to an interconnection line 12 connected to a switching element S15, and the negative terminal of the power source B3 is grounded. Between the interconnection line 12 and the ground line, a switching element S14 is directly connected, and, in addition, a series circuit of a switching element S11, a diode D3, and an inductor L4, and a series circuit of an inductor L4, a diode D4, and a switching element S12 are connected via a common capacitor C2 disposed on the ground side. The diodes D3 and D4 are connected to the capacitor C2 such that the anode of the diode D3 and the cathode of the diode D4 are connected to the capacitor C2.

The interconnection line 12 is connected via the switching element S15 to an interconnection line 13 connected to the negative terminal of the power source B6. The positive terminals of the respective power sources B4 and B5 are grounded. The negative terminal of the power source B4 is connected to the interconnection line 13 via a switching element S16 and a resistor R2. The negative terminal of the power source B5 is connected to the interconnection line 13 via a switching element S17.

The positive terminal of the power source B6 is connected via a switching element S21 to an interconnection line 14 connected to the electrode $Y_j$. The negative terminal of the power source B6 is connected to the interconnection line 13 and also to the interconnection line 14 via a switching element S22. A diode D5 is connected in parallel to the switching element S21, and a diode D6 is connected in parallel to the switching element S22. The diodes D5 and D6 are connected to the interconnection line 14 such that the anode of the diode D5 and the cathode of the diode D6 are connected to the interconnection line 14.

Turning-on/off of each of the switching elements S1 to S4, S8, S11 to S17, S21, and S22 is controlled by a controller 2. In FIG. 11, arrows connected to the respective switching elements denote control signal terminals thereof connected to the controller 2.

In the first sustain driver 7, the power source B3, the switching elements S11 to S15, the inductors L3 and L4, the diodes D3 and D4, and the capacitor C2 form a sustain driver, and the power source B4, the resistor R2, and the switching element S16 form a reset driver. The remaining elements including the power sources B5 and B6, the switching element S13, S17, S21, and S22, and the diodes D5 and D6 form a scan driver.

Referring to a timing chart shown in FIG. 12, the operation of the display device according to the present invention is described below. The operation of the display device includes an operation performed in a reset period, an operation performed in an address period, and an operation performed in a sustain period (emission sustain period).

First, in the reset period, the switching element S8 of the second sustain driver 8 is turned on, and the switching elements S16 and S22 of the first sustain driver 7 are both turned on. The other switching elements remain in the off-state. When the switching elements S16 and S22 are turned on, a current is supplied from the positive terminal of the power source B4 to the electrode Y1 via the switching element S16, the resistor R2, and the switching element S22. On the other hand, when the switching element S8 is turned on, a current is returned from the electrode $X_j$ into the power source B2 via the resistor R1 and the switching element S8. The voltage of the electrode $X_j$ gradually decreases at a rate determined by the time constant of the capacitor C0 and the resistor R1 and serves as a reset pulse $PR_x$. On the other hand, the voltage of the electrode $Y_j$ gradually increases at a rate determined by the time constant of the capacitor C0 and the resistor R2 and serves ad a reset pulse $PR_y$. The voltage of the reset pulse $PR_x$ finally becomes equal to $-V_{r1}$, and the voltage of the reset pulse $PR_y$ finally becomes equal to $V_{r1}$. The reset pulse $PR_x$ is simultaneously applied to all electrodes $X_1$ to $X_n$. The reset pulses $PR_y$ are generated for the respective electrodes $Y_1$ to $Y_n$ and simultaneously applied to all electrodes $Y_1$ to $Y_n$.

As a result of the simultaneous application of the reset pulses $RP_x$ and $RP_y$, a discharge occurs in all discharge cells of the PDP 10 and thus charged particles are created. After completion of the discharge, a predetermined amount of wall charge is uniformly formed on the dielectric layer of each discharge cell.

After the levels of the reset pulses $PR_x$ and $PR_y$ have reached their saturated values, the switching elements S8 and S16 are turned off before the end of the reset period. At this point of time, the switching elements S4, S14, and S15 are turned on, and thus the electrodes $X_j$ and $Y_j$ are both grounded. As a result, the reset pulses $PR_x$ and $PR_y$ disappear.

At the beginning of the address period, the switching elements S14, S15, and S22 are turned off, and the switching element S17 is turned on. At the same time, the switching element S21 is also turned on. As a result, the power source B6 and the power source B5 are connected in series to each other, and thus the potential of the positive terminal of the power source B6 becomes equal to $V_h-V_{off}$. This positive voltage is applied to the electrode $Y_j$ via the switching element S21.

In the address period, the address driver 2 converts each pixel data included in the video signal to pixel data pulses $DP_1$ to $DP_n$ having voltages corresponding to the logical levels of the respective pixel data and sequentially supplies the resultant data to the column electrodes $D_1$ to $D_m$ on a row-by-row basis. To the electrodes $Y_j$ and $Y_{j+1}$, as shown in FIG. 5, pixel data pulses $DP_j$ and $DP_{j+1}$ are applied.

In synchronization with the timings of the pixel data pulses $DP_1$ to $DP_n$ described above, the first sustain driver 7 sequentially supplies a negative scanning pulse SP to the row electrodes $Y_1$ to $Y_n$.

In synchronization with the application of the pixel data pulse $DP_j$ from the address driver 2, the switching element S21 is turned off and the switching element S22 is turned on. As a result, the negative voltage $-V_{off}$ is supplied as a scanning pulse SP from the negative terminal of the power source B5 to the electrode $Y_j$ via the switching element S17 and the switching element S22. In synchronization with the end of the application of the pixel data pulse $SP_j$ from the address driver 2, the switching element S21 is turned on and the switching element S22 is turned off. As a result, the voltage $V_h-V_{off}$ is supplied from the positive terminal of the power source B6 to the electrode $Y_j$ via the switching element S21. Thereafter, to the electrode $Y_{j+1}$ in a similar manner to the electrode $Y_j$, a scanning pulse SP is applied in synchronization with a pixel data pulse $DP_{j+1}$ from the address driver 2 as shown in FIG. 5.

Of discharge cells connected to a row electrode to which the scanning pulse SP is applied, a discharge occurs in discharge cells to which a positive pixel data pulse is also applied, and most wall charge is lost. On the other hand, no discharge occurs in those discharge cells to which the scanning pulse SP is applied but no positive pixel data pulse is applied, and the wall charge remains without being lost. The discharge cells in which the wall charge remains are maintained in the light emission state, while the discharge cells from which the wall charge has been lost are brought into the non-light emission state.

At the transition from the address period to the sustain period, the switching elements S17 and S21 are turned off, and the switching elements S14, S15, and S22 are turned on. However, the switching element S4 is maintained in the on-state.

In the sustain period, the switching element S4 in the second sustain driver 8 is turned on, whereby the voltage of the electrode $X_j$ becomes substantially equal to the ground voltage, that is, 0 V. Thereafter, the switching element S4 is turned off and the switching element S1 is turned on, whereby the charge stored in the capacitor C1 is transferred to the capacitor C0 via the inductor L1, the diode D1, the switching element S1, and the electrode $X_j$. As a result, as shown in FIG. 12, the voltage of the electrode $X_j$ increases at a rate determined by the time constant of the inductor L1 and the capacitor C0.

Thereafter, the switching element S1 is turned off and the switching element S3 is turned on. As a result, the voltage $V_{s1}$ of the positive terminal of the power source B1 is applied to the electrode $X_j$. Thereafter, the switching element S3 is turned off and the switching element S2 is turned on. As a result, the charge stored in the capacitor C0 is transferred into the capacitor C1 via the electrode $X_j$, the inductor L2, the diode D2, and the switching element S2. Thus, as shown in FIG. 12, the voltage of the electrode $X_j$ gradually decreases at a rate determined by the time constant of the inductor L2 and the capacitor C1. When the voltage of the electrode $X_j$ becomes substantially equal to 0 V, the switching element S2 is turned off and the switching element S4 is turned on.

As a result of the above operation, a positive sustain discharge pulse $IP_x$ (each pulse $IP_{x1}$ to $IP_{xi}$ in FIG. 12) is supplied to the electrode $X_j$ from the second sustain driver 8.

Figure 12:
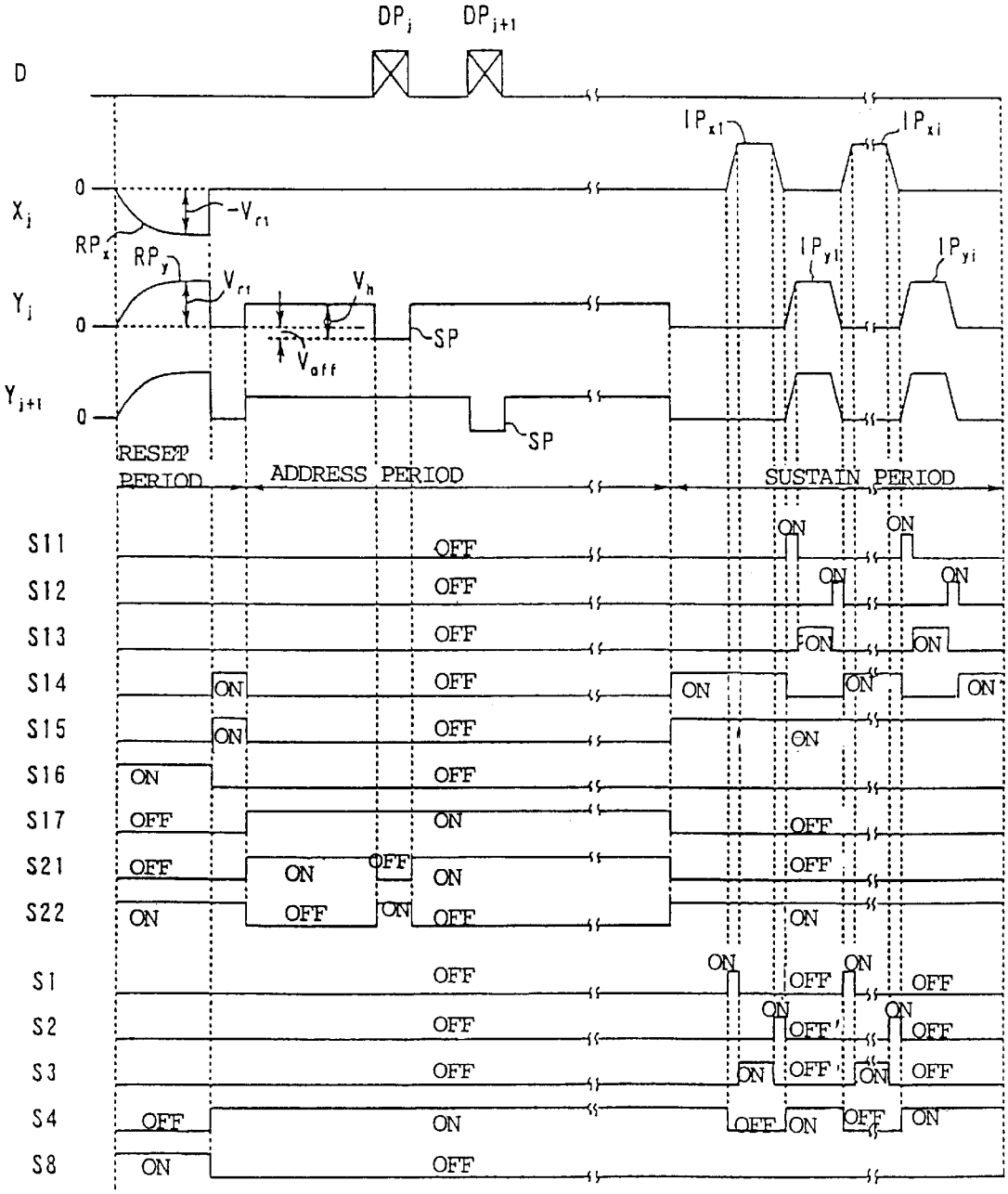
FIG. 12 is a timing chart associated with various parts of the circuit shown in FIG. 11.

In the first sustain driver 7, when the switching element S4 is turned on and the sustain discharge pulse $IP_x$ is eliminated, the switching element S11 is turned on and the switching element S14 is turned off, whereby the voltage of the electrode $Y_j$, which is substantially equal to 0 V when the switching element S14 is in the on-state, gradually increases, as shown in FIG. 12, at a rate determined by the time constant of the inductor L3 and the capacitor C0 because the charge stored in the capacitor C2 is transferred into the capacitor C0 via the inductor L3, the diode D3, the switching element S11, the switching element S15, and the diode D6.

Thereafter, the switching element S11 is turned off and the switching element S13 is turned on. As a result, the voltage $V_{s1}$ of the positive terminal of the power source B3 is applied to the electrode $Y_j$ via the switching element S13, the switching element S15, and the diode D6. Thereafter, when the switching element S13 is turned off and the switching elements S12 is turned on and furthermore the switching element S22 is turned on, the charge stored in the capacitor C0 is transferred into the capacitor C2 via the electrode $Y_j$, the switching element S22, the switching element S15, the inductor L4, the diode D4, and the switching element S12. Thus, as shown in FIG. 12, the voltage of the electrode $Y_j$ gradually decreases at a rate determined by the time constant of the inductor L4 and the capacitor C2. When the voltage of the electrode $Y_j$ becomes substantially equal to 0 V, the switching elements S12 and S22 are turned off and the switching element S14 is turned on.

As a result of the above operation, a positive sustain discharge pulse $IP_y$ (each pulse $IP_{y1}$ to $IP_{yi}$ in FIG. 12) is applied to the electrode $Y_j$ from the first sustain driver 7.

In the sustain period, as described above, the sustain discharge pulse $IP_x$ and the sustain discharge pulse $IP_y$ are alternately generated and alternately applied to the electrodes $X_1$ to $X_n$ and the electrodes $Y_1$ to $Y_n$. As a result, light emission is performed repeatedly in discharge cells in the light emission state in which the wall charge remains in the discharge cells so that the light emission state thereof is maintained.

Figure 13:
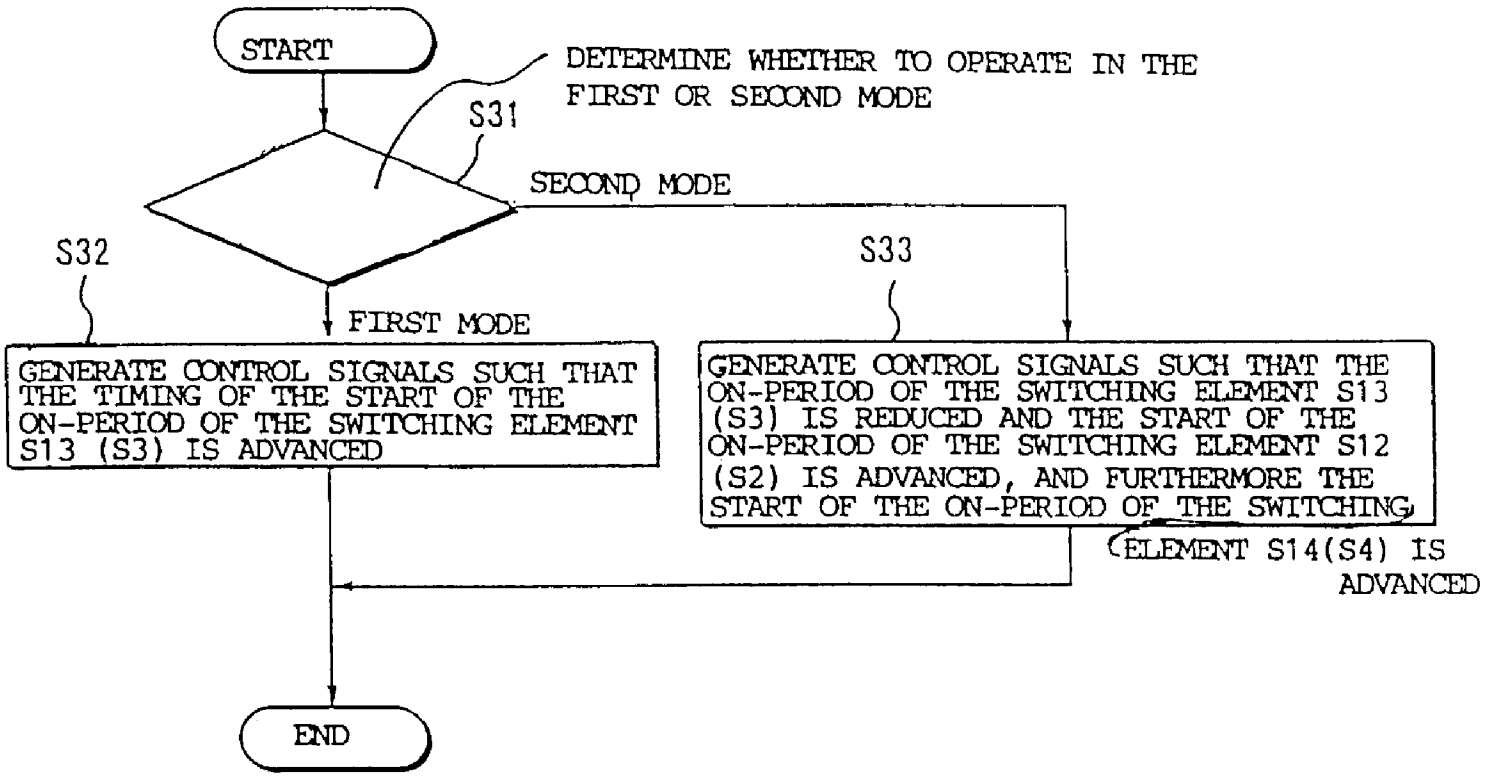
FIG. 13 is a flow chart showing the operation of a driving controller.

During the sustain period, turning-on/off of each of the switching elements S1 to S4 and S11 to S14 is controlled by the controller 2 as shown in FIG. 13. That is, the controller 2 determines whether the ABL controller 31 is in the first or second operation mode (step S31). In the case where the ABL controller 31 is in the first operation mode, the controller 2 generates various control signals such that the timings of the start of the on-periods of the switching elements S3 and S13 are advanced (step S32). In the case of the second mode, control signals are generated such that the timings of the start of the on-periods of the switching elements S2 and S12 are advanced and furthermore the timings of the start of the on-periods of the switching elements S4 and S14 are advanced (step S33).

Figure 14A:
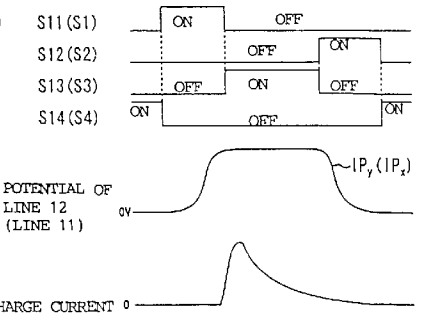
FIGS. 14A to 14C are diagrams showing on-off timings of switches and changes in voltages and discharge currents of lines.

FIG. 14A shows the timings of turning on/off the switching elements S11 to S14 in the first sustain driver 7 during the sustain period according to the conventional technique and also shows a resultant change in the voltage of the line 12 and a resultant change in the discharge current. The timings of turning on/off the switching elements S1 to S4 in the second sustain driver 8 and resultant changes in the voltage of the line 11 and the discharge current are similar to those of the first sustain driver 7, as denoted by parenthesized reference symbols. This is also true in FIGS. 14B and 14C.

Figure 14B:
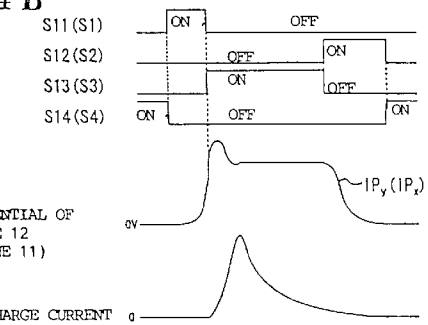

FIG. 14B shows the timings of turning on/off the switching elements S11 to S14 (S1 to S4) in the first mode during the sustain period and also shows a resultant change in the voltage of the line 12 (line 11) and a resultant change in the discharge current. In the first mode, when the switching element S11 (S1) is turned on and the switching element S14 (S14) is simultaneously turned off, the capacitor C0 disposed between the electrodes $Y_j$ and $X_j$ is charged up by a current caused by the turning-on/off of the switching elements S11 and S14. As a result, the voltage of the line 12 (line 11) and the voltage of the electrode $Y_j$ ($X_j$) gradually increase. Before the voltage of the electrode Y1 ($X_j$) reaches $V_{s1}$, the switching element S13 (S3) is turned on. As a result, the voltage of the electrode $Y_j$ ($X_j$) is clamped to the voltage $V_{s1}$ output from the power source B3 (B1). Because of resonance that still occurs even after the voltage of the electrode $Y_j$ ($X_j$) has been clamped, an overshoot in the voltage of the electrode $Y_j$ ($X_j$) occurs and the voltage of the electrode $Y_j$ ($X_j$) becomes higher than the voltage $V_{s1}$, as shown in FIG. 14B. Furthermore, the peak level of the discharge current becomes higher than that according to the conventional technique. The above effect will also be achieved if the output voltage of the power source B3 (B1) is equivalently increased. The voltage overshoot results in an increase in a vacuum ultraviolet ray radiated from xenon gas sealed in the discharge space, and the increase in the vacuum ultraviolet ray results in an increase in the amount of color light emitted by excitation by the vacuum ultraviolet ray upon a fluorescent layer and thus results in an increase in luminance. Thus, it becomes possible to achieve an increase in the peak luminance.

Figure 14C:
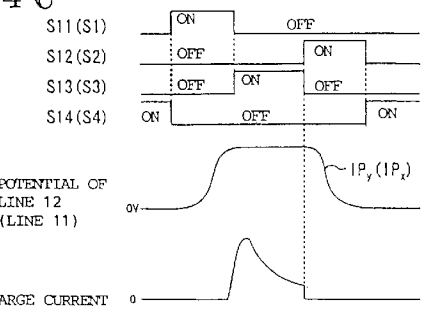

FIG. 14C shows the timings of turning on/off the switching elements S11 to S14 (S1 to S4) in the second mode during the sustain period and also shows a resultant change in the voltage of the line 12 (line 11) and a resultant change in the discharge current. In this second mode, the length of the on-period of the switching element S11 (S1) and the timing of the start of the on-period of the switching element S13 (S3) are similar to those shown in FIG. 14A for the conventional apparatus. However, the length of the on-period of the switching element S13 (S3) is shorter than that shown in FIG. 14A for the conventional apparatus, and the switching element S12 (S2) is turned on earlier than is turned on in the conventional apparatus. As a result, the discharge current flowing between the electrodes $Y_j$ and $X_j$ abruptly drops to 0 in the middle of gradual reduction as shown in FIG. 14C. This, the discharge is limited, and a reduction in the power consumption and an increase in the emission efficiency can be achieved.

In FIGS. 14A to 14C, the timings of the end of the on-period of the switching elements S11 and S1 may be located anywhere within the period from the time at which the switching elements S13 and S3 are turned on to the time at which the switching elements S12 and S2 are turned on.

The timings of the end of the on-period of the switching elements S12 and S2 may be located anywhere within the period from the time at which the switching elements S14 and S4 are turned on to the time at which the switching elements S11 and S1 are turned on.

As described above, when the ABL controller 31 operates in the first mode that is employed when the mean luminance level is low, the luminance can be increased. On the other hand, in the second mode that is employed when the means luminance level is high, a reduction in the power consumption and an improvement in the emission efficiency can be achieved.

In the embodiment described above, one field of display period is divided into N (14, for example) subfields to represent as many gradation levels as the number of gradation levels achieved by the one reset one selective erase address scheme plus one (14+1=15 levels). The present invention may also be applied when $2^N$ gradation levels are represented using N subfields according to the conventional technique. Furthermore, the driving method is not limited to that based on the selective erase addressing scheme, and a driving method based on the selective write addressing scheme may also be employed.

The present invention may also be applied to any display device using a display driving pulse generator including a resonance circuit and a power limiting circuit (automatic brightness limiting circuit).

As described above, the present invention makes it possible to achieve improvements in the luminance and emission efficiency during the light emission sustain period.

This application is based on a Japanese Patent Application No. 2001-155473 which is hereby incorporated by reference.

What is claimed is:

1. A display device comprising:

a display panel including a plurality of pairs of row electrodes between which a capacitive load is formed, and a plurality of column electrodes arrayed in the direction intersecting with the row electrodes so as to form discharge cells at respective intersections of the row electrode pairs and the column electrodes;

a driver circuit for supplying a sustain discharge pulse between a pair of row electrodes by performing a process having: under a state fixed one row electrode for each of the pairs of row electrodes at a first potential in a light emission sustain period of the display panel, a first step of gradually changing the potential of the other row electrode for each of the pairs of row electrodes from the first potential toward a second potential by means of resonance between the capacitive load and a first inductor; a second step of fixing the other row electrode in the pair of row electrodes at the second potential; and a third step of gradually changing the potential of the other row electrode of the pair of row electrodes from the second potential toward the first potential by means of resonance between the capacitive load and a second inductor; and a power limiting circuit for limiting power consumption of said driver circuit, in accordance with luminance information of an input image signal;

wherein when the power consumption of the driver circuit is not limited by the power limiting circuit, the driver circuit performs the second step before the potential of the other row electrode of the pair of row electrodes reaches the second potential at the first step, while when the power consumption of the driver circuit is limited by the power limiting circuit, the driver circuit reduces the length of the period of the second step and performs the third step after completion of the reduced second step.

2. A display device according to claim 1, wherein when the power consumption of the driver circuit is not limited by the power limiting circuit, the sustain discharge pulse supplied between the pair of row electrodes has a overshoot portion on the leading edge, and the pulse width of the sustain discharge pulse supplied between the pair of row electrodes when the power consumption of the driver circuit is limited by the power limiting circuit is narrower than that when the power consumption of the driver circuit is not limited by the power limiting circuit.

3. A method of driving a display panel having a plurality of pairs of row electrodes between which a capacitive load is formed, and a plurality of column electrodes arrayed in the direction intersecting with the row electrodes so as to form discharge cells at respective intersections of the row electrode pairs and the column electrodes, the method comprising:

supplying a sustain discharge pulse between a pair of row electrodes by performing a process having, under a state fixed one row electrode for each of the pairs of row electrodes at a first potential in a light emission sustain period of the display panel, a first step of gradually changing the potential of the other row electrode for each of the pairs of row electrodes from the first potential toward a second potential by means of resonance between the capacitive load and a first inductor; a second step of fixing the other row electrode in the pair of row electrodes at the second potential; and a third step of gradually changing the potential of the other row electrode of the pair of row electrodes from the second potential toward the first potential by means of resonance between the capacitive load and a second inductor;

performing the second step before the potential of the other row electrode of the pair of row electrodes reaches the second potential at the first step when power consumption is not limited; and reducing the length of the period of the second step and performing the third step after completion of the reduced second step when power consumption is limited.

4. A method according to claim 3, wherein when the power consumption is not limited, the sustain discharge pulse supplied between the pair of row electrodes has a overshoot portion on the leading edge, and the pulse width of the sustain discharge pulse supplied between the pair of row electrodes when the power consumption is limited is narrower than that when the power consumption is not limited.

* * * * *